US011686552B2

(12) United States Patent
Wortman

(10) Patent No.: US 11,686,552 B2
(45) Date of Patent: Jun. 27, 2023

(54) CHEST PACK HOLSTER

(71) Applicant: Brian Wortman, Elk Ridge, UT (US)

(72) Inventor: Brian Wortman, Elk Ridge, UT (US)

( * ) Notice: Subject to any disclaimer, the term of this patent is extended or adjusted under 35 U.S.C. 154(b) by 0 days.

(21) Appl. No.: 17/475,118

(22) Filed: Sep. 14, 2021

(65) Prior Publication Data

US 2023/0077535 A1 Mar. 16, 2023

(51) Int. Cl.
*F41C 33/02* (2006.01)
*F41C 33/04* (2006.01)
*A45F 3/06* (2006.01)

(52) U.S. Cl.
CPC ..... *F41C 33/0209* (2013.01); *F41C 33/041* (2013.01); *A45F 3/06* (2013.01)

(58) Field of Classification Search
CPC .... F41C 33/041; F41C 33/046; F41C 33/048; A45F 2200/0591; A45F 3/04; A45F 3/06; A45F 2003/148
See application file for complete search history.

(56) References Cited

U.S. PATENT DOCUMENTS

| | | | | |
|---|---|---|---|---|
| 3,269,620 | A | 8/1966 | Du | |
| 5,246,153 | A | 9/1993 | Beletsky | |
| 5,431,318 | A | 7/1995 | Garcia | |
| 6,131,198 | A | 10/2000 | Westrick | |
| 6,415,541 | B1 | 7/2002 | Rassias | |
| 7,258,259 | B1 | 8/2007 | Owens | |
| 8,672,201 | B2 | 3/2014 | Craighead | |
| 9,227,573 | B2 | 1/2016 | Hudspeth | |
| 9,297,611 | B1 * | 3/2016 | Roccisano | F41C 33/041 |
| 9,301,595 | B2 | 4/2016 | Tedder | |
| D773,805 | S * | 12/2016 | Paniwozik | D3/222 |
| D789,078 | S * | 6/2017 | Paniwozik | D3/222 |
| 9,702,659 | B2 | 7/2017 | Bowman | |
| 9,933,233 | B1 | 4/2018 | Roccisano | |
| 9,933,235 | B1 | 4/2018 | Beard et al. | |
| 10,184,754 | B2 | 1/2019 | Laemmlen | |
| D840,147 | S | 2/2019 | Shults et al. | |
| 10,415,927 | B1 * | 9/2019 | Shults | F41C 33/0209 |
| 10,772,412 | B2 | 9/2020 | Tedder et al. | |
| D915,062 | S * | 4/2021 | Oller | D29/101.1 |
| 11,441,871 | B1 * | 9/2022 | Weber | F41C 33/041 |
| 2003/0038151 | A1 | 2/2003 | Mason | |

(Continued)

OTHER PUBLICATIONS

Maska Guide Creations Holster, Accessed at https://alaskaguidecreations.com/products/pistol-holster, Accessed on Sep. 10, 2021, 9 Pages.

(Continued)

*Primary Examiner* — Corey N Skurdal
(74) *Attorney, Agent, or Firm* — David McKenzie; Maywood IP Law

(57) ABSTRACT

A chest pack holster can include a pocket designed to receive at least part of a handgun body of a handgun. The chest pack holster can include strap fasteners that are designed to fasten the chest pack holster to securing straps of a chest pack (such as side straps and/or shoulder straps). At least part of the chest pack holster can be positioned between a pack body of the chest pack and a wearer of the chest pack. The securing straps of the chest pack can be designed to extend around a torso of the wearer of the chest pack to assist in securing the chest pack to the wearer of the chest pack.

17 Claims, 7 Drawing Sheets

(56) References Cited

U.S. PATENT DOCUMENTS

| | | | |
|---|---|---|---|
| 2003/0213827 | A1 | 11/2003 | Langmuir |
| 2004/0084494 | A1 | 5/2004 | Gilliam |
| 2010/0176167 | A1 | 7/2010 | Hudspeth |
| 2013/0193172 | A1 | 8/2013 | Damkot et al. |
| 2013/0264364 | A1 | 10/2013 | D'orazio et al. |
| 2016/0091279 | A1 | 3/2016 | Massaro, Jr. |
| 2017/0115095 | A1 | 4/2017 | Moultrie et al. |
| 2019/0017778 | A1 | 1/2019 | Tedder et al. |
| 2019/0128640 | A1 | 5/2019 | Shinkle |
| 2020/0408487 | A1 | 12/2020 | Foster |
| 2021/0140739 | A1 | 5/2021 | Houck |

OTHER PUBLICATIONS

ASCP Nosegunner, Accessed at https://eberlestock.com/products/nosegunner. Accessed on Jun. 15, 2021, 1 Page (front view).

ASCP Nosegunner, Accessed at https://eberlestock.com/products/nosegunner. Accessed on Jun. 15, 2021, 1 Page (rear view).

ASCP Nosegunner, Accessed at https://eberlestock.com/products/nosegunner. Accessed on Jun. 15, 2021, 1 Page (Top view).

Bino Harness Chest Holster Gen 2, Accessed at https://www.razcogear.com/online-store-1/Bino-Harness-Holster-Gen-2-p303565375, Accessed on Sep. 10, 2021, 3 Pages.

Clearance Thumb Break Scabbard, Accessed at https://www.desantisholster.com/clearance-thumb-break-scabbard/, Accessed on Sep. 10, 2021, 1 Page.

Pack Mount Holster, Accessed at https://www.razcogear.com/online-store-1/Pack-Mount-Holster-p333680044, Accessed on Sep. 10, 2021, 3 Pages.

Razco Holster for AGC Bino Pack, Accessed at https://alaskaguidecreations.com/products/razco-holster-for-agc-bino-pack, Accessed on Sep. 10, 2021, 7 Pages.

* cited by examiner

CHEST PACK HOLSTER

BACKGROUND

Chest packs are packs that are designed to be worn with the main compartment of the pack against a wearer's chest (as used herein, the chest refers to the front of a person's torso). For example, some such packs are binocular packs that are designed and used for carrying binoculars in a compartment against the wearer's chest.

Holsters are designed to hold firearms such as handguns, typically with the holster fastened to a person's body. For example, some holsters are designed to be secured to clothing on a person's waist. Other holsters are designed to be secured on other areas of a person's body.

SUMMARY

Features of a novel chest pack holster apparatus and chest pack holster techniques are discussed herein.

According to a first aspect, a chest holster apparatus can include a chest pack holster. The chest pack holster can include a pocket designed to receive at least part of a handgun body of a handgun (the portion of the handgun that is attached to the top of the grip at an attachment area and extends distally from the attachment area, typically including the barrel). The chest pack holster can also include a first side strap fastener connected to the pocket, the first side strap fastener being designed to fasten the chest pack holster to a first side strap of a chest pack, with the first side strap extending outward from a first side of a pack body the chest pack. The chest pack holster can also include a second side strap fastener connected to the pocket, the second side strap fastener being designed to fasten the chest pack holster to a second side strap of the chest pack, with the second side strap extending outward from a second side of the pack body of the chest pack, the second side of the pack body of the chest pack being opposite the first side of the pack body of the chest pack. The chest pack holster can also include a shoulder strap fastener designed to fasten the chest pack holster to a shoulder strap of the chest pack, the shoulder strap extending up from a top of the pack body of the chest pack.

According to a second aspect, a chest pack holster apparatus can include a chest pack holster. The chest pack holster can include a pocket designed to receive at least part of a handgun body of a handgun. The chest pack holster can also include strap fasteners that are designed to fasten the chest pack holster to securing straps of a chest pack with at least part of the chest pack holster positioned between a pack body of the chest pack and a wearer of the chest pack. The securing straps of the chest pack can be designed to extend around a torso of the wearer of the chest pack to assist in securing the chest pack to the wearer of the chest pack.

According to a third aspect, a technique can include removably fastening one or more strap fasteners of a chest pack holster to one or more securing straps of a chest pack, although the chest pack holster may be secured in some other manner. The technique can further include placing the chest pack on a body of a wearer of the chest pack. The one or more securing straps of the chest pack can assist in securing the chest pack to the wearer with the chest pack being adjacent to a chest of the wearer. Also, at least a portion of the chest pack holster can be positioned between the chest pack and the chest of the wearer.

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

I. General Chest Pack Holster Apparatus

Figure 1:
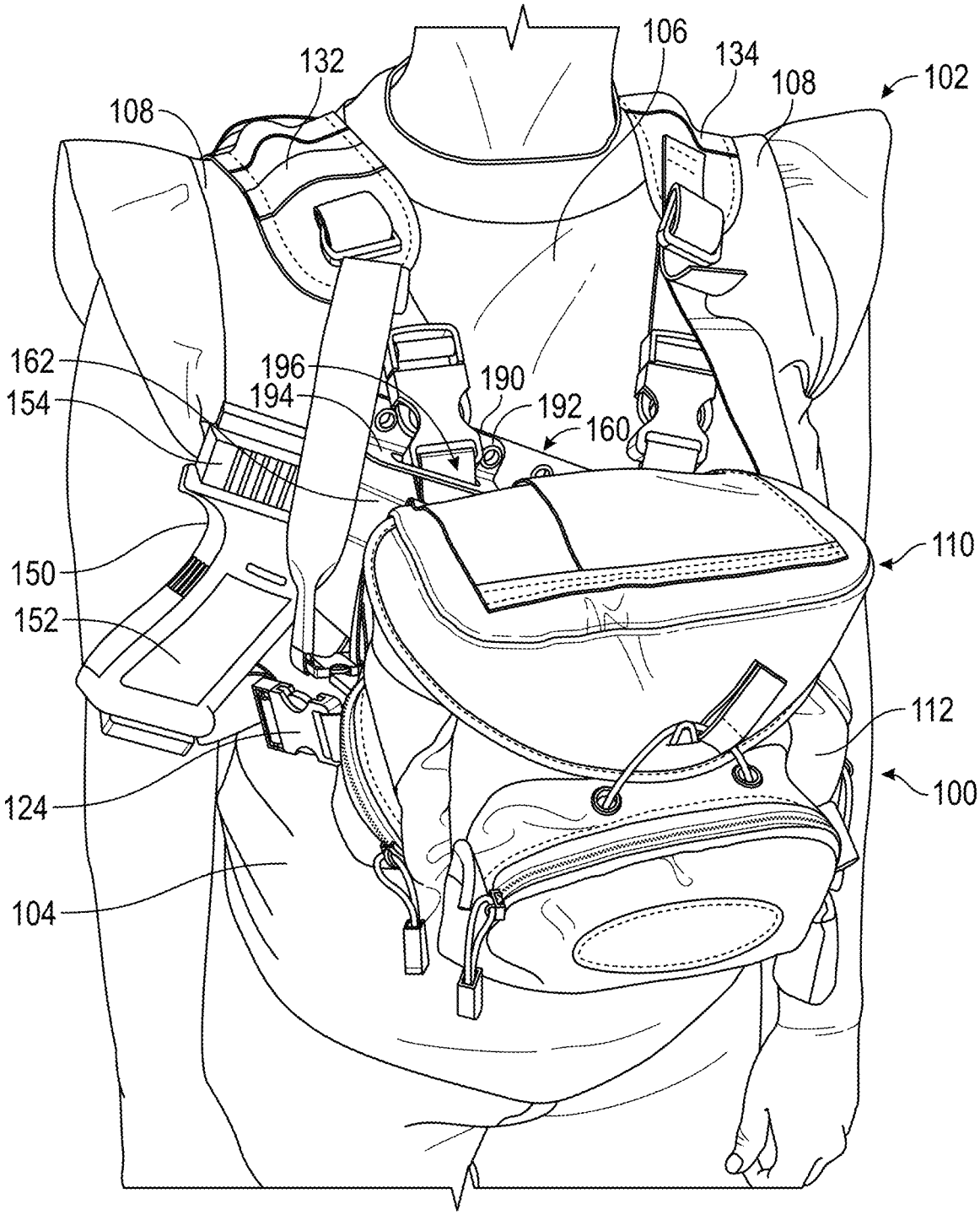
FIG. 1 is a perspective view of a chest holster apparatus being worn by a person.
Figure 2:
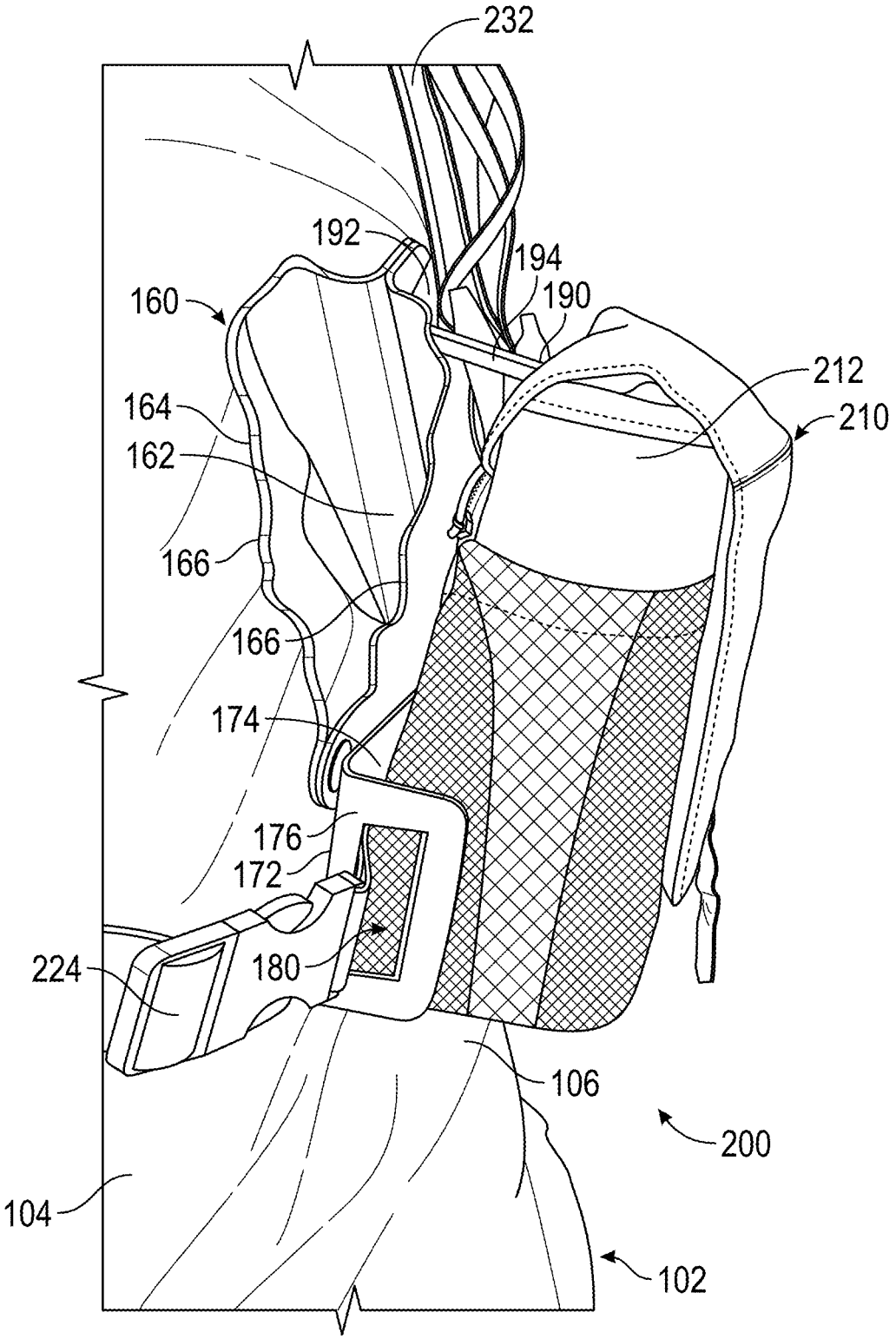
FIG. 2 is a right-side view of a chest holster apparatus being worn by a person.
Figure 3:
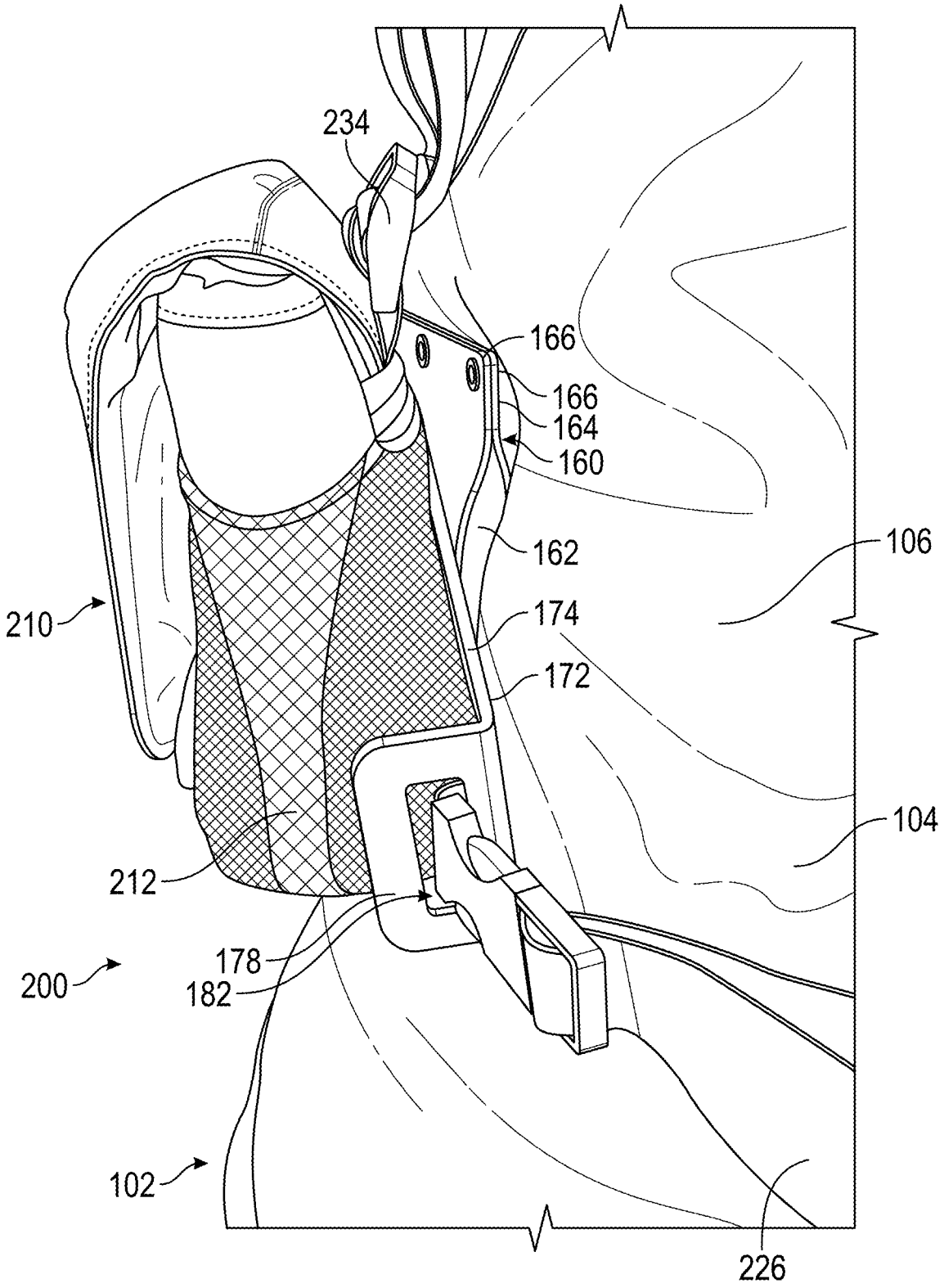
FIG. 3 is a left-side view of the chest holster apparatus of FIG. 2 being worn by a person.
Figure 4:
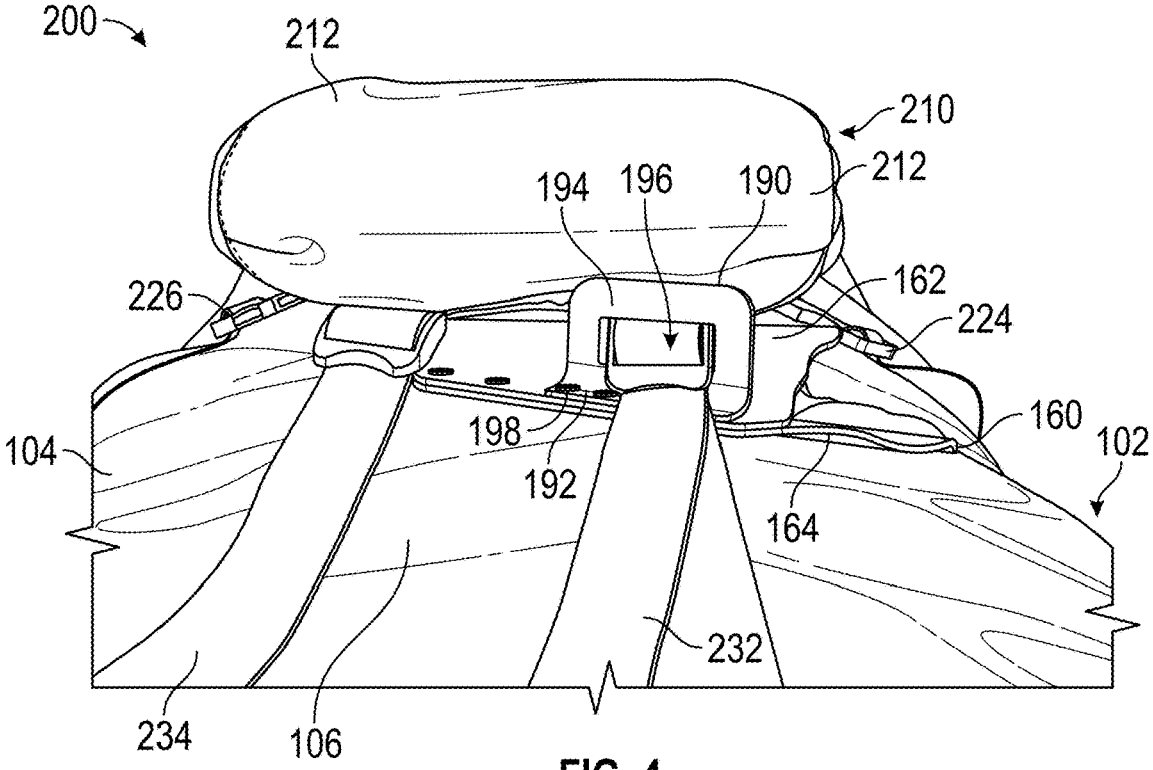
FIG. 4 is a top view of the chest holster apparatus of FIG. 2 being worn by a person.
Figure 5:
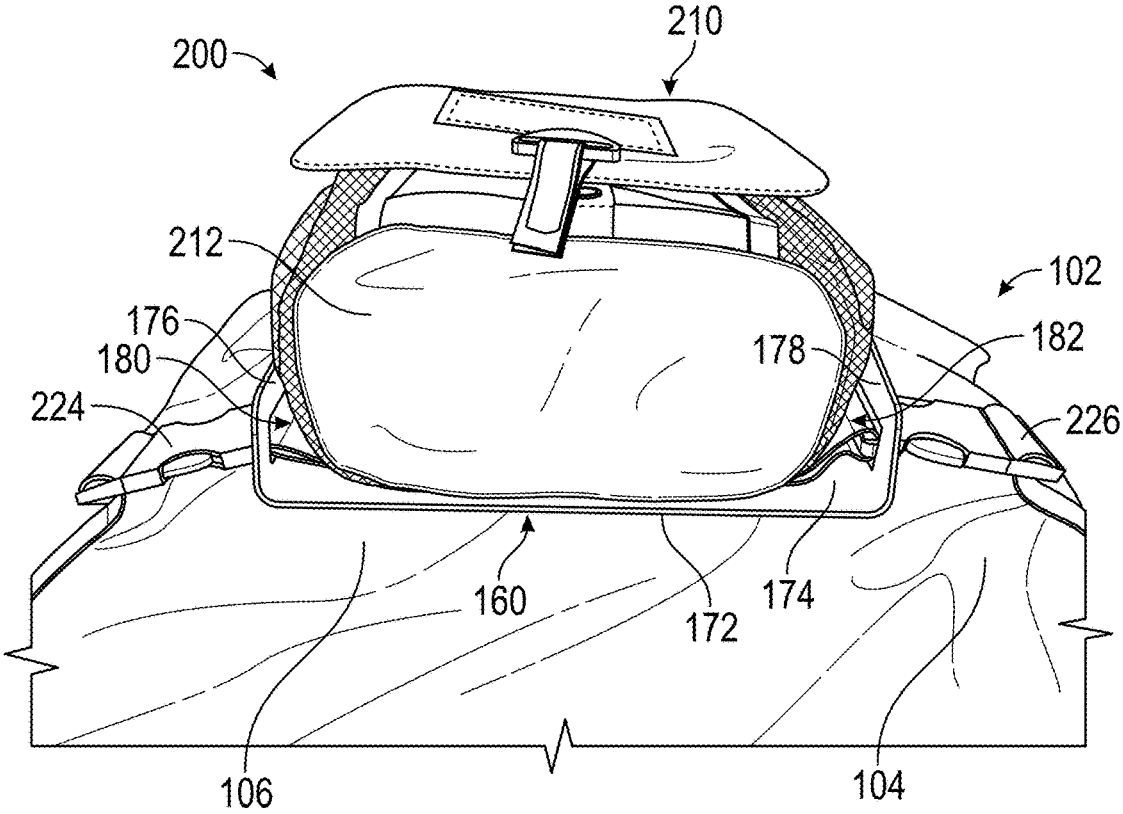
FIG. 5 is a bottom view of the chest holster apparatus of FIG. 2 being worn by a person.
Figure 6:
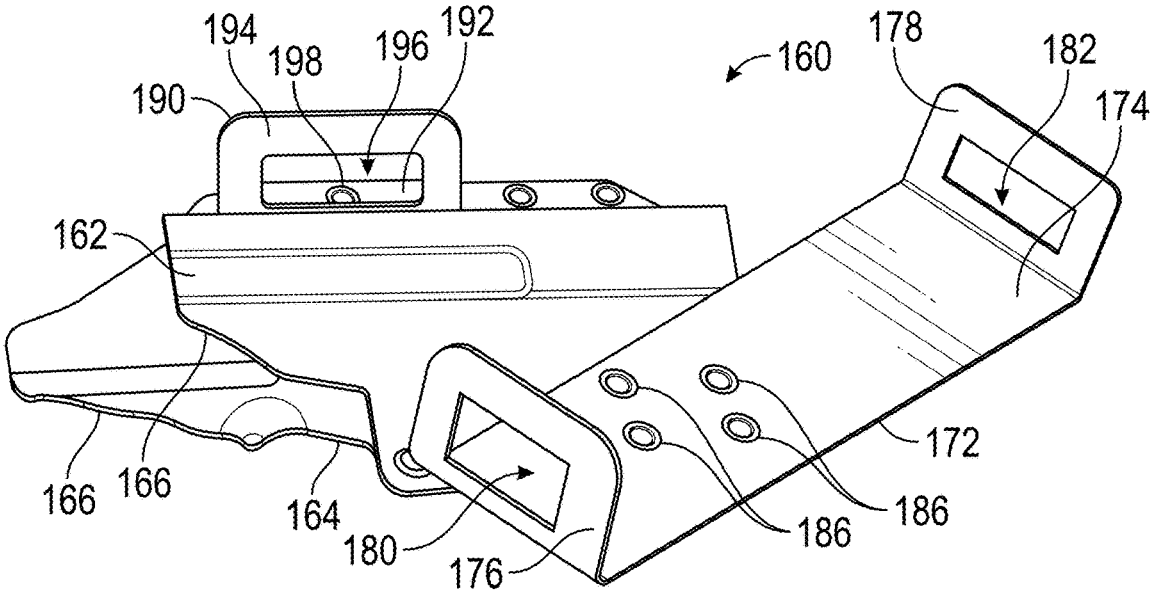
FIG. 6 is a front-bottom-right perspective view of a holster of the chest holster apparatus of FIG. 2.
Figure 7:
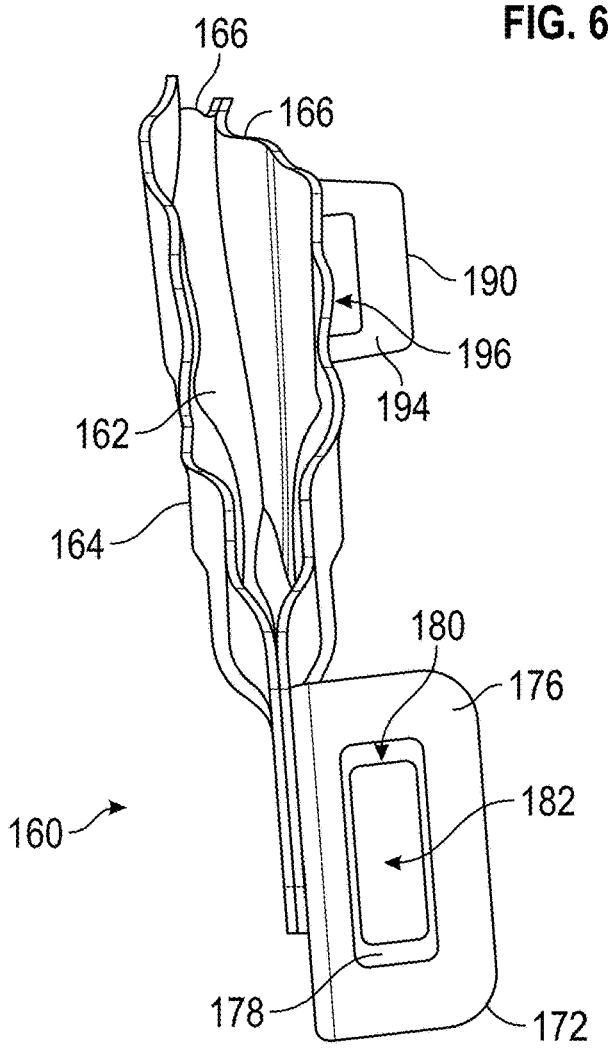
FIG. 7 is a right-side view of the chest holster of FIG. 6.
Figure 8:
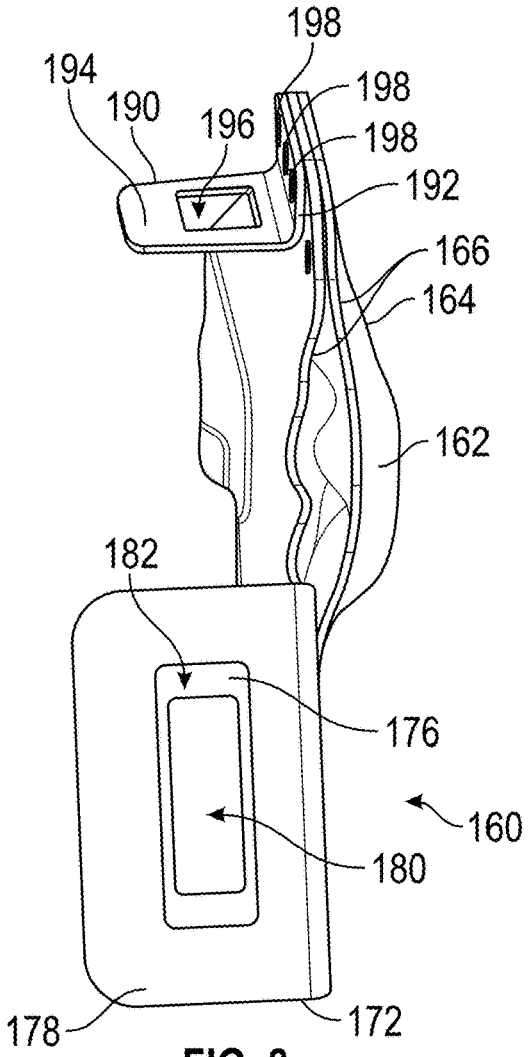
FIG. 8 is a left-side view of the chest holster of FIG. 6.
Figure 9:
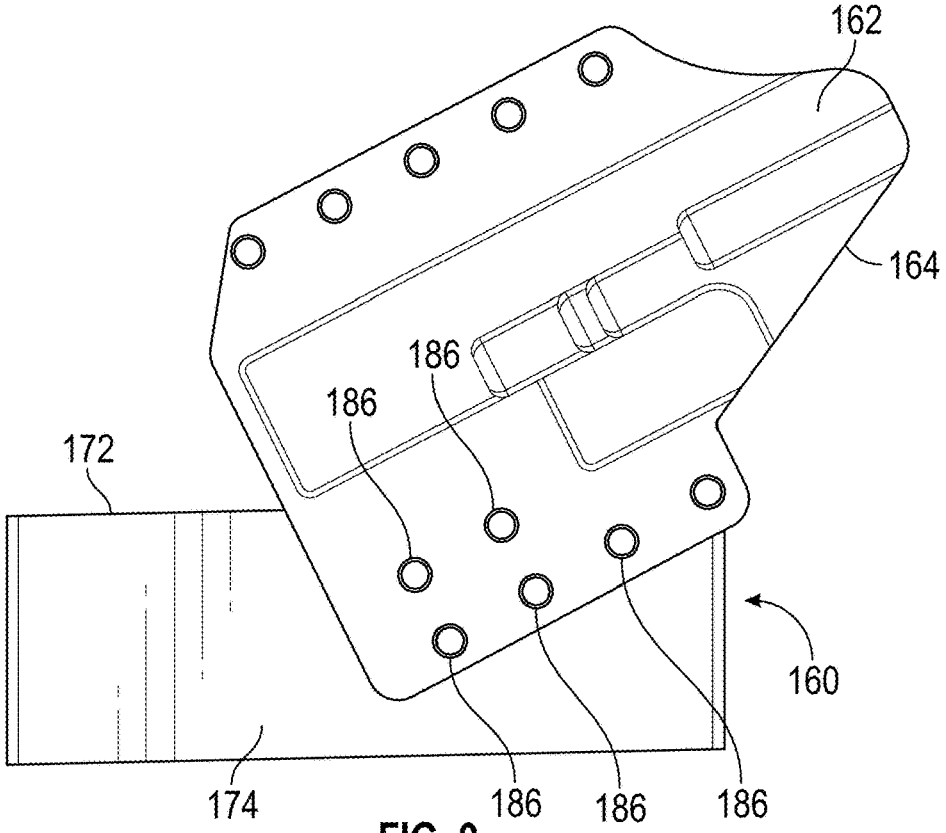
FIG. 9 is a rear view the chest holster of FIG. 6.
Figure 10:
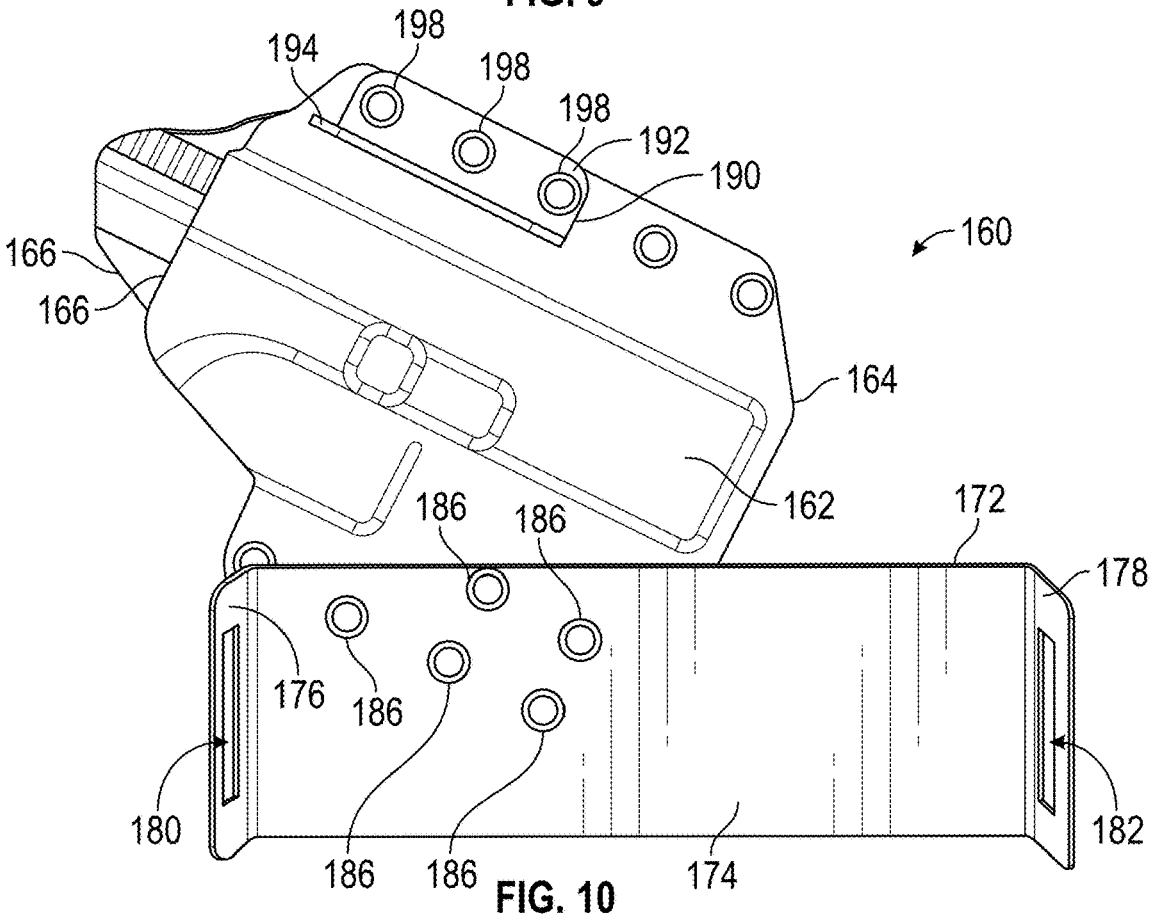
FIG. 10 is a front view of the chest holster of FIG. 6.
Figure 11:
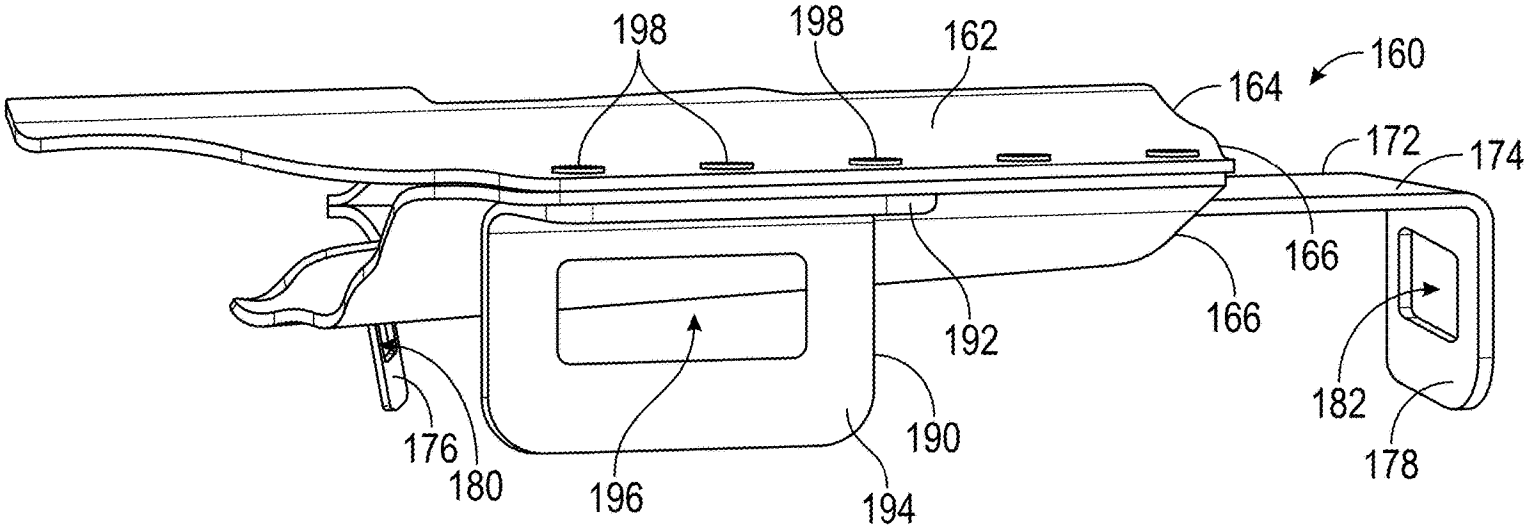
FIG. 11 is a top view of the chest holster of FIG. 6.
Figure 12:
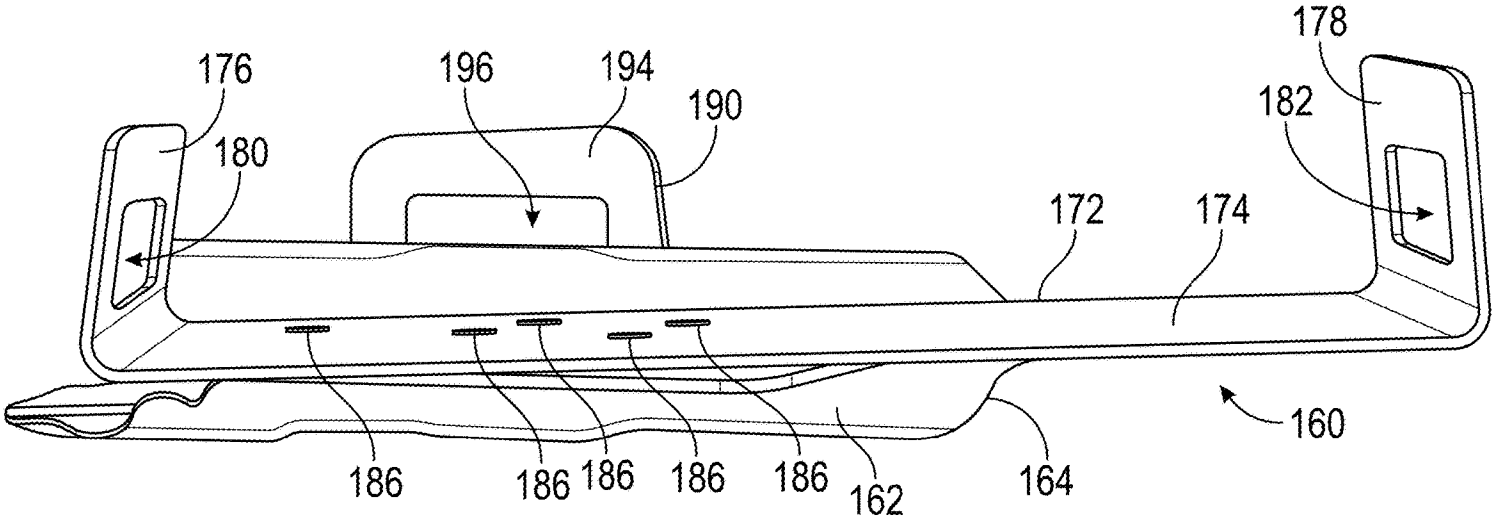
FIG. 12 is a bottom view of the chest holster of FIG. 6.

Referring to FIG. 1, a chest pack holster apparatus 100 can be worn by a person, with the person wearing the chest pack holster apparatus 100 also being referred to as a wearer 102 having a torso 104 including a chest 106 as well as shoulders 108. The chest pack holster apparatus 100 can include a chest pack 110.

The chest pack 110 can include a pack body 112, such as a bag, having at least one compartment. The pack body 112 can rest on the chest 106 of the wearer 102. The chest pack 110 can be secured to the wearer using securing straps. As used herein, securing straps are straps that secure a chest pack to a wearer, such as shoulder straps and side straps that extend around a wearer's torso to secure the chest pack to the wearer. Each strap can include features such as one or more elongate strips and/or cords, padding, buckles, stitching, and/or other features. Also, the straps may have different shapes, such as having flattened cross sectional shapes as illustrated, or having circular cross-sectional shapes (being shaped like rounded cords or other shapes). The securing straps can include a pair of side straps, which can include a right-side strap 124 that can extend from the pack body 112 back and to the right around the right side of the torso 104 of the wearer 102. Similarly, the side straps can also include a left-side strap (not shown in FIG. 1) that can extend from the pack body 112 back and to the left around the left side of the torso 104 of the wearer 102. The securing straps can also include a pair of shoulder straps, which can include a right shoulder strap 132 and a left shoulder strap 134. The securing straps can be joined to each other directly or indirectly at the back of the wearer 102. For example, all the securing straps may be joined at a single junction or at multiple junctions that are joined together.

The chest pack holster apparatus 100 can hold a firearm, such as a handgun 150, which can include a grip 152 and a handgun body 154 that extends distally from the grip 152. For example, the handgun body 154 may include a barrel, a chamber, at least a portion of a frame, a slide (common in semi-automatic handguns), a cylinder (common in revolvers), and/or other parts. The handgun 150 may also include other features, such as a trigger, trigger guard, etc. The handgun 150 may be any of multiple different types of handguns, such as a cartridge-firing handgun, a muzzle loading handgun, an electroshock weapon, a paintball gun, or an airsoft gun. The chest pack holster apparatus 100 can include a chest pack holster 160. The chest pack holster 160 can include a pocket 162 and multiple strap fasteners, which can be designed to removably fasten the chest pack holster 160 to the securing straps of the chest pack 110.

II. Chest Pack Holster Details

The chest pack holster 160 will be discussed in more detail with reference to FIGS. 2-12. FIGS. 2-5 illustrate another chest pack holster apparatus 200 that includes the same chest pack holster 160 fastened to a different chest pack 210. The chest pack holster 160 can be used with the same or different chest pack, which may be a first wearer 102 and a second wearer 102, with the first and second wearers 102 being the same person or a different person.

As with the chest pack 110, the chest pack 210 can include a pack body 212, such as a bag, having at least one compartment. The pack body 212 can rest on the chest 106 of the wearer 102. The chest pack 210 can be secured to the wearer 102 using securing straps. The securing straps can include a pair of side straps, which can include a right-side strap 224 that can extend from the pack body 212 back and to the right around the right side of the torso 104 of the wearer 102. Similarly, the side straps can also include a left-side strap 226 that can extend from the pack body 212 back and to the left around the left side of the torso 104 of the wearer 102. The securing straps can also include a pair of shoulder straps, which can include a right shoulder strap 232 and a left shoulder strap 234. The securing straps can be joined to each other directly or indirectly at the back of the wearer 102. For example, all the securing straps may be joined at a single junction or at multiple junctions that are joined together.

Referring still to FIGS. 2-12, as discussed above, the chest pack holster 160 can include a pocket 162 and strap fasteners. More specifically, the pocket 162 can be formed by a holster body 164. In one implementation illustrated in the figures, the holster body 164 can be formed of a pair of sheets 166 shaped to form the pocket 162 to receive the handgun body 154 of a handgun 150. For example, the sheets may be polymer materials, such as thermoplastics. In one example, the sheets may be made of thermoplastic sheets sold under the name KYDEX®. The sheets 166 of the holster body 164 can be held together with fasteners such as rivets spaced around a periphery of the holster body 164. The sheets 166 of the holster body 164 can be shaped to fit a particular handgun model. Additionally, fasteners such as rivets can secure the strap fasteners to the holster body 164 of the chest pack holster 160. The same fasteners may help to secure the sheets 166 together and help to secure strap fasteners to the holster body 164.

In one implementation, the chest pack holster 160 can include a side strap fastener bracket 172. The side strap fastener bracket 172 can include an elongate strip 174 that can be in line with the holster body 164, and can abut the holster body 164. The elongate strip 174 can extend horizontally along a bottom of the holster body 164. At each end of the elongate strip 174, the side strap fastener bracket 172 can bend forward to form a right-side strap fastener 176 on one end and a left-side strap fastener 178 on the opposite end. For example, the right-side strap fastener 176 and the left-side strap fastener 178 can each extend at an angle from the elongate strip 174. For example, each side strap fastener may be substantially perpendicular to the elongate strip 174. The right-side strap fastener 176 can define an opening 180 such as a through hole therein that is sized to receive a side strap of a chest pack. The right-side strap fastener 176 can encompass the opening 180, or the opening 180 may be partially open (i.e., not fully encompassed). Similarly, the left-side strap fastener 178 can define an opening 182 such as a through hole therein that is sized to receive a side strap of a chest pack. The left-side strap fastener 178 can encompass the opening 182, or the opening 182 may be partially open. The elongate strip 174 of the side strap fastener bracket 172 can be secured to the holster body 164, such as with rivets or other side strap bracket fasteners 186.

The strap fasteners of the chest pack holster 160 can also include a shoulder strap fastener bracket 190. The shoulder strap fastener bracket 190 can include a mounting sheet 192 that can be in line with the holster body 164, and can abut the holster body 164. The mounting sheet 192 can be positioned at a top of the holster body 164. The shoulder strap fastener bracket 190 can also include a shoulder strap fastener 194, which can bend forward from the mounting sheet 192 to form the shoulder strap fastener 194. For example, the shoulder strap fastener 194 can extend at an angle from the mounting sheet 192. For example, the shoulder strap fastener 194 may be substantially perpendicular to the mounting sheet 192. The shoulder strap fastener 194 can define an opening 196 such as a through hole therein that is sized to receive a shoulder strap of a chest pack. The shoulder strap fastener 194 can encompass the opening 196, or the opening 196 may be partially open. The mounting sheet 192 of the shoulder strap fastener bracket 190 can be secured to the holster body 164, such as with rivets or other shoulder strap bracket fasteners 198.

The strap fasteners discussed above and illustrated in the figures can fasten the chest pack holster 160 to the securing straps of the chest pack without fixing the fasteners to the securing straps, so that the straps can slide relative to the strap fasteners at least while the straps are loose. For example, in the examples illustrated, the fasteners can perform their fastening without gripping or clamping to the securing straps or extending through small holes in the securing straps. In some examples, one or more of the strap fasteners of the chest pack holster may be fixed to one or more corresponding securing straps, such as be gripping, clamping to, or extending through the one or more corresponding securing straps. The chest pack holster 160 could use different types of strap fasteners to fasten the chest pack holster 160 to the securing straps of a chest pack. For example, the strap fasteners could define partially open openings to receive the securing straps. Also, the strap fasteners could utilize clamping mechanisms to clamp the strap fasteners to the securing straps. As another example, the strap fasteners could comprise other types of fasteners to extend through holes in the securing straps of the chest pack, such as threaded fasteners (e.g., screws or bolts with mating threaded nuts that could extend through holes in the holster and in the securing straps of the chest pack). Moreover, the chest pack holster could have different configurations of strap fasteners, such as only having two shoulder strap fasteners, having two shoulder strap fasteners and a single side strap fastener, or having two shoulder strap fasteners and two side strap fasteners.

Additionally, the chest pack holster could be a mirror image of the one shown for a left-handed wearer (so that the handle of the handgun could be accessible from the left side of the chest pack instead of the right side of the chest pack as shown in FIGS. 1-5). Also, the chest pack holster could be configured so that the handgun was accessible from the top or bottom of the pack body of the chest pack, instead of a side of the pack body of the chest pack.

III. Positioning of Chest Pack Holster Apparatus

While the chest pack holster apparatus 200 is being worn by a wearer 102, the chest pack 210 can be positioned as illustrated above in FIGS. 2-5 (and as illustrated for chest pack 110 in FIG. 1). As discussed above, the right-side strap 224 can extend from the pack body 212 back and to the right around the right side of the torso 104 of the wearer 102, and a left-side strap 226 can extend from the pack body 212 back and to the left around the left side of the torso 104 of the wearer 102. The right shoulder strap 232 can extend up from the pack body 212 over the right shoulder of the wearer 102 and the left shoulder strap 234 can extend up from the pack body over the left shoulder of the wearer 102. As discussed above, the securing straps of the chest pack 210 can be directly or indirectly connected to each other at the back of the wearer (not shown in the figures).

The chest pack holster 160 can be positioned between the pack body 212 of the chest pack 210 and the chest 106 of the wearer 102. The strap fasteners of the chest pack holster can extend forward, away from the chest 106 of the wearer 102 and toward and/or around the pack body 212 of the chest pack 210. For example, as illustrated in FIG. 1, the right-side strap fastener 176 and the left-side strap fastener 178 can extend forward into the pack body 112 of the chest pack 110 (so that they are not seen in FIG. 1). However, as illustrated in FIGS. 2-5, the right-side strap fastener 176 and the left-side strap fastener 178 can extend forward on opposite sides of the pack body 212 of the chest pack 210. These different positions of the strap fasteners relative to different chest packs illustrate that the chest pack holster 160 may be used with different sizes and types of chest packs, even if the strap fasteners are in different locations relative to the different chest packs due to their different designs and/or sizes. The right-side strap 224 of the chest pack 210 can extend through the opening 180 in the right-side strap fastener 176, the left-side strap 226 of the chest pack 210 can extend through the opening 182 in the left-side strap fastener 178, and one of the shoulder straps (the right shoulder strap 232 in the Figures) can extend through the opening in the shoulder strap fastener 194. Thus, the mating of the chest pack holster's strap fasteners (the right-side strap fastener 176, the left-side strap fastener 178, and the shoulder strap fastener 194) with the chest pack's securing straps can fasten the chest pack holster 160 to the chest pack 210.

The chest pack holster 160 can have a positive holster cant relative to a horizontal line extending through the right strap fastener 176 and the left strap fastener 178. For example, the positive holster cant may be between one degree and ninety degrees, such as between one degree and sixty degrees, such as between one degree and forty-five degrees, or between one degree and thirty degrees. In some implementations, the positive holster cant may be between twenty degrees and thirty degrees, such as about twenty-seven degrees.

As illustrated in the figures the opening of the pocket 162 of the chest pack holster 160 can open to the right side of the wearer 102. Accordingly, the grip 152 of the handgun 150 can be accessible to be grasped from the right side of the wearer 102 with the right hand of the wearer 102. Alternatively, a chest pack holster may be a mirror image of the chest pack holster illustrated in the figures, and such a holster may be fastened to the left shoulder strap and a handgun grip may be accessible from the left side of the wearer 102 with the left hand of the wearer 102.

The chest pack holster 160 can be removed from one chest pack, such as the chest pack 110, and can be fastened to a different chest pack, such as the chest pack 210. Indeed, a single chest pack holster 160 may be fastened to and used with any of a variety of different styles and sizes of chest packs, so long as their securing straps can be fastened with the strap fasteners of the chest pack holster 160 (threaded through the fastener openings of the chest pack holster 160, in the illustrated example, or fastened with other types of fasteners in other examples). Because a wide variety of chest packs have similar strap configurations, the chest pack holster 160 can be used with a wide variety of sizes and/or designs of chest packs.

IV. Use of the Chest Pack Holster Apparatus

Use of the chest pack holster apparatus 200 will now be discussed. In use, the chest pack holster 160 can be secured to the chest pack 210 in the position discussed above and illustrated in the figures by threading the securing straps of the chest pack through the openings of the strap fasteners of the chest pack holster 160. For example, this may include detaching buckles of the securing straps, threading portions of the securing straps through the openings and re-attaching the buckles of the securing straps. With the chest pack holster 160 fastened to the chest pack 210, the chest pack 210 can be placed on the wearer 102 in a typical manner for the chest pack 210 being used. A handgun 150 can be placed in the chest pack holster 160, as illustrated with the chest pack holster apparatus 100 of FIG. 1. The wearer 102 can then proceed to hike or perform some other activity while wearing the chest pack holster apparatus 100 or 200. The wearer 102 can access the grip 152 of the handgun 150 from the side of the pack body 112 of the chest pack 110. Thus, the wearer 102 can grasp the grip 152 of the handgun 150 and pull the handgun 150 out of the chest pack holster 160, and can grasp the grip 152 of the handgun 150 and push the handgun 150 back into the chest pack holster 160. This insertion and removal of the handgun 150 into and out of the chest pack holster 160 can be repeated by the wearer 102.

V. Materials and Manufacturing of the Chest Pack Holster

In an example making the chest pack holster, sheets of polymer material such as thermoplastic material can be cut into basic sheet sizes. The sheets of polymer material can be heated to a sufficiently high temperature so that the sheets can be molded. For example, with sheets of material sold under the name KYDEX®, the sheets may be molded to a temperature of about 322 degrees Fahrenheit. However, different temperatures can be used for different types of materials. A pair of sheets can then be placed around a gun mold that mimics the shape of a handgun for which the holster is designed to form the holster body 164. A holster mold press can press the sheets into the gun mold while the sheets cool. For example, the sheets may cool in the press for about fifteen minutes. The sheets can then be taken out of the press and allowed to cool for about another ten minutes. Holes can then be drilled in the sheets and the sheets can be clamped together with bolts. The sheets can then be cut to the shape of the holster body 164, such as by using a power saw (e.g., a scroll saw). The edges can be sanded, and the bolts can be removed. A buffing mill can then be used to smooth the edges of the sheets that are to form the holster body 164.

The fastener brackets can also be formed of the same types of sheets as the holster body 164. To form the brackets, rectangles can be cut out of sheets of the material. The opening holes can then be cut into the rectangles. A heat gun can be used to heat across lines where the cut-out sheets are to be bent to form the brackets. While the bend lines are heated on a cut-out sheet, the sheet can be clamped at an angle such as ninety degrees to produce a lasting bend in the bracket. Holes may then be drilled in the brackets. Fasteners such as rivets can then be fastened through the drilled holes in the brackets and the sheets for the holster body, to secure the brackets to the holster body and to secure the sheets of the holster body together.

The chest pack holster 160 can be formed of different materials and made in different ways than discussed above. For example, the chest pack holster could be injection molded as a single piece or multiple pieces. As another example, the chest pack holster could be made of sheets of leather instead of sheets of polymer materials. Such leather sheets could be cut and shaped using leather manufacturing techniques.

VI. Chest Pack Holster Aspects

Some examples of aspects of the chest pack holster discussed herein will now be explained. The different features discussed in the same or different aspects can be used together in any combination of features, so long as the features are not inconsistent with each other.

According to a first aspect, a chest pack holster apparatus can include a chest pack holster. The chest pack holster can include a pocket designed to receive at least part of a handgun body of a handgun. The chest pack holster can also include a first side strap fastener connected to the pocket, the first side strap fastener being designed to fasten the chest pack holster to a first side strap of a chest pack, with the first side strap extending outward from a first side of a pack body the chest pack. The chest pack holster can also include a second side strap fastener connected to the pocket, the second side strap fastener being designed to fasten the chest pack holster to a second side strap of the chest pack, with the second side strap extending outward from a second side of the pack body of the chest pack, the second side of the pack body of the chest pack being opposite the first side of the pack body of the chest pack. The chest pack holster can also include a shoulder strap fastener designed to fasten the chest pack holster to a shoulder strap of the chest pack, where the shoulder strap extends up from a top of the pack body of the chest pack.

The chest pack holster can be designed to be removably fastened to the chest pack using the first side strap fastener, the second side strap fastener, and the shoulder strap fastener. Further, the first side strap fastener can define a first side strap opening that is designed to receive the first side strap, the second side strap fastener can define a second side strap opening that is designed to receive the second side strap, and the shoulder strap fastener can define a shoulder strap opening that is designed to receive the shoulder strap.

The chest pack holster can have a positive holster cant relative to a line extending from the first side strap fastener to the second side strap fastener. For example, the positive cant may be between one degree and forty-five degrees.

The chest pack holster can be designed to be positioned with at least a portion of the pocket of the chest pack holster being between a pack body of the chest pack and a torso of a wearer of the chest pack with the chest pack holster fastened to the chest pack. Also, the chest pack holster can be designed to be positioned so that a handle of a handgun is accessible from a side of the chest pack with the handgun seated in the chest pack holster, with a handgun body of the handgun extending at least partially into the pocket of the chest pack holster, and with at least part of the handgun body of the handgun being positioned between a pack body of the chest pack and a torso of a wearer of the chest pack.

The chest pack holster apparatus can further include the chest pack. The first side strap fastener can fasten the chest pack holster to the first side strap of the chest pack. Additionally, the second side strap fastener can fasten the chest pack holster to the second side strap of the chest pack, and the shoulder strap fastener can fasten the chest pack holster to the shoulder strap of the chest pack. Moreover, the chest pack holster can be secured to the chest pack so that at least part of the pocket of the chest pack holster is positioned between the chest pack and a torso of a wearer of the chest pack when the chest pack is worn as designed.

According to a second aspect, a chest pack holster apparatus can include a chest pack holster. The chest pack holster can include a pocket designed to receive at least part of a handgun body of a handgun. The chest pack holster can also include strap fasteners that are designed to fasten the chest pack holster to securing straps of a chest pack. For example, the strap fasteners may be designed to fasten the chest pack holster to at least two of the securing straps of the chest pack, or at least three of the securing straps of the chest pack (e.g., two side straps and a shoulder strap, or two shoulder straps and a side strap). At least part of the chest pack holster can be positioned between a pack body of the chest pack and a wearer of the chest pack. The securing straps of the chest pack can be designed to extend around a torso of the wearer of the chest pack to assist in securing the chest pack to the wearer of the chest pack.

The chest pack holster apparatus can further include the chest pack. The chest pack holster can be fastened to the securing straps of the chest pack so that when the chest pack is worn as designed, at least part of the chest pack holster is positioned between a pack body of the chest pack and a torso of a wearer of the chest pack.

The strap fasteners can include a first side strap fastener designed to fasten the chest pack holster to a first side strap of the chest pack that extends outward from a first side of a pack body of the chest pack. The strap fasteners can also include a second side strap fastener designed to fasten the chest pack holster to a second side strap of the chest pack that extends outward from a second side of the pack body of the chest pack, with the second side of the pack body of the chest pack being opposite the first side of the pack body of the chest pack. The strap fasteners can also include a shoulder strap fastener designed to fasten the chest pack holster to a shoulder strap of the chest pack that extends up from a top of the pack body of the chest pack.

The chest pack holster can be designed to be removably fastened to the chest pack using the strap fasteners. The strap fasteners can include a fastener that defines a strap opening that is designed to receive a strap of the securing straps of the chest pack, with the strap extending through the strap opening. The strap fasteners can include three strap fasteners that are designed to fasten the chest pack holster to three of the securing straps of the chest pack.

According to a third aspect, a technique can include removably fastening one or more strap fasteners of a chest pack holster to one or more securing straps of a chest pack. The technique can further include placing the chest pack on a body of a wearer of the chest pack. The one or more securing straps of the chest pack can assist in securing the chest pack to the wearer with the chest pack being adjacent to a chest of the wearer. Also, at least a portion of the chest pack holster can be positioned between the chest pack and the chest of the wearer.

The technique can further include placing a handgun in the chest pack holster while the wearer is wearing the chest pack, with part of the handgun being positioned in the chest pack holster so that a handle of the handgun extends out to a side of the chest pack.

Removably fastening the one or more strap fasteners of the chest pack holster to the one or more securing straps of the chest pack can include positioning each of the one or more securing straps to extend through an opening in a corresponding one of the one or more strap fasteners.

The one or more securing straps can include a first side strap extending outward from a first side of the chest pack and around a side of the wearer of the chest pack; a second side strap extending outward from a second side of the chest pack and around a side of the wearer of the chest pack; and a shoulder strap extending up from the chest pack and over a shoulder of the wearer of the chest pack. Also, removably fastening the one or more strap fasteners of the chest pack holster to the one or more securing straps of the chest pack can include fastening a first side strap fastener to the first side strap, fastening a second side strap fastener to the second side strap, and fastening a shoulder strap fastener to the shoulder strap.

Fastening the first side strap fastener to the first side strap can include positioning the first side strap through an opening of the first side strap fastener. Fastening the second side strap fastener to the second side strap can include positioning the second side strap through an opening of the second side strap fastener. Also, fastening the shoulder strap fastener to the shoulder strap can include positioning the shoulder strap through an opening of the shoulder strap fastener.

The chest pack can be a first chest pack, and the wearer can be a first wearer. The first wearer can be either the same person as a second wearer or a different person from the second wearer. The technique can further include removably fastening one or more strap fasteners of the chest pack holster to one or more securing straps of a second chest pack that is a different design from the first chest pack. The technique can also include placing the second chest pack on a body of the second wearer of the second chest pack. The one or more securing straps of the second chest pack can assist in securing the second chest pack to the second wearer with the second chest pack being adjacent to a chest of the second wearer, and at least a portion of the second chest pack holster being positioned between the second chest pack and the chest of the second wearer.

The subject matter defined in the appended claims is not necessarily limited to benefits that may be described herein. A particular implementation of the invention may provide all, some, or none of the benefits described herein. Although operations for the various techniques are described herein in a particular, sequential order for the sake of presentation, it should be understood that this manner of description encompasses rearrangements in the order of operations, unless a particular ordering is required. For example, operations described sequentially may in some cases be rearranged or performed concurrently. Techniques described herein may be used with one or more of the systems described herein and/or with one or more other systems.

While particular embodiments are discussed above, it will be understood by those skilled in the art that various changes in form and details may be made therein without departing from the spirit and scope of the invention.

I claim:

1. A chest pack holster apparatus comprising:

a chest pack; and a chest pack holster comprising:

a holster body comprising a top and a bottom, the holster body designed to receive at least part of a handgun body of a handgun;

a fastener bracket connected to the holster body proximal to one of the top and the bottom;

a first strap fastener connected to the fastener bracket, the first strap fastener fastens the holster body to a first strap of the chest pack;

a second strap fastener connected to the holster body, the second strap fastener fastens the holster body to a second strap of the chest pack; and a shoulder strap fastener connected to the holster body, the shoulder strap fastener fastens the holster body to a shoulder strap of the chest pack.

2. The chest pack holster apparatus of claim 1, wherein the fastener bracket connects to the bottom of the holster body and wherein the fastener bracket comprises a bend that connects the fastener bracket and the first strap fastener.

3. The chest pack holster apparatus of claim 1, wherein the first strap fastener defines a first strap opening designed to receive the first strap, and the second strap fastener defines a second strap opening designed to receive the second strap.

4. The chest pack holster apparatus of claim 1, wherein the chest pack holster has a positive holster cant between one degree and forty-five degrees relative to a line extending from the first strap fastener to the second strap fastener.

5. The chest pack holster apparatus of claim 1, wherein the chest pack holster apparatus further comprises a shoulder strap fastener bracket configured to couple the shoulder strap fastener to the holster body.

6. The chest pack holster apparatus of claim 1, wherein the second strap fastener connects to the holster body by way of the fastener bracket, the second strap fastener opposite the first strap fastener and where the chest pack holster comprises:

a second fastener bracket connected to the holster body proximal to the other one of the top and the bottom opposite the first fastener bracket; and a third strap fastener connected to the holster body by way of the second fastener bracket.

7. The chest pack holster apparatus of claim 1, wherein the chest pack holster is designed to be positioned so that a handle of the handgun is accessible from a side of the chest pack with the handgun seated in the chest pack holster with the handgun body of the handgun extending at least partially into the pocket of the chest pack holster, and with at least part of the handgun body of the handgun being positioned between the pack body of the chest pack and a torso of a wearer of the chest pack.

8. The chest pack holster apparatus of claim 1, wherein the chest pack holster is secured to the chest pack so that at least part of the holster body of the chest pack holster is positioned between the chest pack and a torso of a wearer of the chest pack when the chest pack is worn as designed.

9. A chest pack holster apparatus comprising:

a chest pack holster comprising:

a pocket designed to receive at least part of a handgun body of a handgun, the pocket comprising a top and a bottom;

a fastener bracket connected to the pocket near the bottom; and a first strap fastener connected to the fastener bracket by a first bend;

a second strap fastener connected to the fastener bracket opposite the first strap fastener by way of a second bend;

a second fastener bracket connected to the pocket proximal to the top of the pocket;

a third strap fastener connected to the pocket by way of the second fastener bracket, the third strap fastener integrated with the second fastener bracket; and wherein the first strap fastener and second strap fastener are designed to fasten the chest pack holster to straps of a chest pack with at least part of the chest pack holster positioned between a pack body of the chest pack and a wearer of the chest pack.

10. The chest pack holster apparatus of claim 9, further comprising the chest pack, wherein the chest pack holster is fastened to the securing straps of the chest pack so that when the chest pack is worn as designed, at least part of the chest pack holster is positioned between a pack body of the chest pack and a torso of a wearer of the chest pack.

11. The chest pack holster apparatus of claim 9, wherein the chest pack holster is designed to be removably fastened to the chest pack using one or more of the first strap fastener and the second strap fastener.

12. The chest pack holster apparatus of claim 9, wherein the first strap fastener, second strap fastener, and third strap fastener are designed to fasten the chest pack holster to three straps of the chest pack.

13. A chest pack holster apparatus comprising:

a chest pack holster comprising:

a holster body designed to receive at least part of a handgun body of a handgun, the holster body comprising a top and a bottom;

a side strap fastener bracket connected to the bottom of the holster body, the side strap fastener bracket comprising:

a first end;

a second end;

an elongate strip between the first end and the second end;

a first side strap fastener connected to the side strap fastener bracket at the first end;

a second side strap fastener connected to the side strap fastener bracket at the second end;

wherein the first side strap fastener and second side strap fastener are configured to engage straps of a chest pack with at least part of the chest pack holster positioned between a pack body of the chest pack and a wearer of the chest pack; and wherein the side strap fastener bracket connects to the bottom of the holster body by way of one or more rivets.

14. The chest pack holster apparatus of claim 13, wherein the chest pack holster further comprises:

a shoulder strap fastener bracket connected to the top of the holster body, the shoulder strap fastener bracket comprising:

a first end;

a second end connected to the holster body;

a shoulder strap fastener connected to the shoulder strap fastener bracket at the first end;

wherein the shoulder strap fastener is configured to engage a shoulder strap of the chest pack.

15. The chest pack holster apparatus of claim 14, wherein the first end and the second end of the side strap fastener bracket each comprise a bend that connects an end of the side strap fastener bracket to one of the first side strap fastener and the second side strap fastener.

16. The chest pack holster apparatus of claim 15, wherein at least one bend is configured to extend a corresponding side strap fastener toward a chest pack when the chest pack holster is removably fastened to the chest pack.

17. The chest pack holster apparatus of claim 16, wherein the elongate strip comprises a length that positions the first end near a first side of the chest pack and the second end near a second side of the chest pack, such that each bend extends one of the first side strap fastener and the second side strap fastener around a side of the chest pack.

* * * * *